US010071559B2

(12) United States Patent
Smith et al.

(10) Patent No.: US 10,071,559 B2
(45) Date of Patent: Sep. 11, 2018

(54) SELF-SEALING FILTER MODULE FOR INKJET PRINTING

(71) Applicant: VIDEOJET TECHNOLOGIES, INC., Wood Dale, IL (US)

(72) Inventors: Robert Smith, Thrapston (GB); Michael Stamp, Leicester (GB); Paul King, Whittlesey (GB)

(73) Assignee: VIDEOJET TECHNOLOGIES INC., Wood Dale, IL (US)

( * ) Notice: Subject to any disclaimer, the term of this patent is extended or adjusted under 35 U.S.C. 154(b) by 0 days.

(21) Appl. No.: 15/316,330

(22) PCT Filed: Jun. 3, 2015

(86) PCT No.: PCT/US2015/033997
§ 371 (c)(1),
(2) Date: Dec. 5, 2016

(87) PCT Pub. No.: WO2015/187839
PCT Pub. Date: Dec. 10, 2015

(65) Prior Publication Data

US 2017/0197425 A1 Jul. 13, 2017

Related U.S. Application Data

(60) Provisional application No. 62/008,228, filed on Jun. 5, 2014.

(51) Int. Cl.
*B41J 2/175* (2006.01)
*B41J 2/02* (2006.01)

(52) U.S. Cl.
CPC ..... *B41J 2/17563* (2013.01); *B41J 2/02* (2013.01); *B41J 2/17596* (2013.01); *B41J 2202/20* (2013.01)

(58) Field of Classification Search
CPC .... B41J 2/175; B41J 2/17513; B41J 2/17556; B41J 2/055
See application file for complete search history.

(56) References Cited

U.S. PATENT DOCUMENTS 4,338,610 A 7/1982 Sellen et al.
4,364,055 A 12/1982 Aiba
(Continued)

FOREIGN PATENT DOCUMENTS

DE 102010016858 A1 11/2011
EP 0531156 A2 3/1993
(Continued)

*Primary Examiner* — John P Zimmermann
(74) *Attorney, Agent, or Firm* — Beusse, Wolter, Sanks & Maire, PLLC; Robert L. Wolter

(57) ABSTRACT

A filter module (38) for a continuous inkjet printer (10) comprising a filter housing (40) and a filter medium (42) fixed within the housing (40). The filter housing (40) further includes an inlet portal (44) through which ink flows into the housing under pressure and a first self-sealing valve assembly (54) disposed within the inlet portal. In addition, housing includes an outlet portal (46) through which ink flows out of the housing (40) under pressure and a second self-sealing valve assembly (56) disposed within the outlet portal (46). The first and second valve assemblies (54, 56) open when mechanically connected to an ink flow path (34) from an ink tank (18) to a print head (14), and the first and second valve assemblies (54, 56) seal closed when mechanically disconnected from the ink flow path (34).

13 Claims, 4 Drawing Sheets

(56) References Cited

U.S. PATENT DOCUMENTS

| | | | | |
|---|---|---|---|---|
| 4,568,947 | A | 2/1986 | Regnualt | |
| 4,682,183 | A | 7/1987 | Elchinger et al. | |
| 4,791,434 | A | 12/1988 | Wills | |
| 4,800,398 | A | 1/1989 | Naruse et al. | |
| 4,847,631 | A | 7/1989 | Naruse et al. | |
| 4,990,932 | A | 2/1991 | Houston | |
| 5,030,973 | A | 7/1991 | Nonoyama et al. | |
| 5,160,939 | A | 11/1992 | Bajeux et al. | |
| 5,455,606 | A | 10/1995 | Keeling et al. | |
| 5,455,611 | A | 10/1995 | Simon et al. | |
| 5,491,499 | A | 2/1996 | Bibbe et al. | |
| 5,541,632 | A * | 7/1996 | Khodapanah | B41J 2/175 347/87 |
| 5,623,292 | A | 4/1997 | Shrivastava et al. | |
| 5,710,579 | A | 1/1998 | Hahs et al. | |
| 5,793,398 | A | 8/1998 | Hennig | |
| 5,796,419 | A | 8/1998 | Clark et al. | |
| 6,250,747 | B1 * | 6/2001 | Hauck | B41J 2/17556 347/86 |
| 6,280,023 | B1 | 8/2001 | Ufkes | |
| 6,357,860 | B1 | 3/2002 | Rhodes | |
| 6,464,322 | B2 | 10/2002 | Dunand | |
| 6,467,880 | B2 | 10/2002 | Rhodes | |
| 6,607,257 | B2 | 8/2003 | Szumla et al. | |
| 6,622,266 | B1 | 9/2003 | Goddard et al. | |
| 6,712,451 | B2 | 3/2004 | Madziarz et al. | |
| 6,726,298 | B2 | 4/2004 | Anderson et al. | |
| 6,866,367 | B2 | 3/2005 | Szumla | |
| 7,346,086 | B2 | 3/2008 | Ryan et al. | |
| 7,393,085 | B2 | 7/2008 | Lecheheb et al. | |
| 8,342,666 | B2 * | 1/2013 | Lee | B41J 2/175 347/17 |
| 8,444,258 | B2 * | 5/2013 | Suzuki | B41J 2/17509 347/85 |
| 8,449,054 | B2 | 5/2013 | Harris et al. | |
| 8,454,128 | B2 | 6/2013 | Fishkin et al. | |
| 8,474,930 | B2 | 7/2013 | Rasmussen | |
| 2005/0110836 | A1 | 5/2005 | Colombat et al. | |
| 2007/0064068 | A1 | 3/2007 | Piatt | |
| 2008/0170108 | A1 | 7/2008 | Lee et al. | |
| 2008/0284835 | A1 | 11/2008 | Panchawagh | |
| 2009/0033727 | A1 | 2/2009 | Anagnostopoulos et al. | |
| 2009/0120512 | A1 | 5/2009 | Berry et al. | |
| 2010/0045758 | A1 | 2/2010 | Okazawa | |
| 2010/0238243 | A1 | 9/2010 | Tomlin et al. | |
| 2011/0316933 | A1 | 12/2011 | Fishkin et al. | |
| 2013/0057904 | A1 | 3/2013 | Soto et al. | |

FOREIGN PATENT DOCUMENTS

| | | | |
|---|---|---|---|
| EP | 0805037 | A2 | 4/1997 |
| EP | 0780231 | A1 | 6/1997 |
| EP | 1093918 | B1 | 4/2001 |
| EP | 0813974 | B1 | 3/2003 |
| EP | 1013458 | | 8/2003 |
| EP | 1847391 | A1 | 10/2007 |
| EP | 2082883 | A2 | 7/2009 |
| EP | 2393054 | A1 | 7/2011 |
| EP | 2555113 | A1 | 6/2013 |
| FR | 2636884 | A1 | 3/1990 |
| GB | 2447919 | A | 10/2008 |
| GB | 2479751 | A | 10/2011 |
| JP | 5896561 | | 6/1983 |
| JP | 60187556 | | 9/1985 |
| JP | 2000229419 | | 8/2000 |
| WO | 199706009 | A1 | 2/1997 |
| WO | 199828146 | A1 | 7/1998 |
| WO | 2002100645 | | 12/2002 |
| WO | 2008050141 | A1 | 5/2008 |
| WO | 2009049130 | A1 | 4/2009 |
| WO | 2015187839 | A1 | 12/2015 |
| WO | 2015187926 | A1 | 12/2015 |
| WO | 2015187983 | A2 | 12/2015 |

* cited by examiner

SELF-SEALING FILTER MODULE FOR INKJET PRINTING

FIELD OF INVENTION

The present disclosure relates to ink jet printing and more particularly to filtration of ink supplied to a print head of a continuous ink jet printer.

BACKGROUND

In ink jet printing systems the print is made up of individual droplets of ink generated at a nozzle and propelled towards a substrate. There are two principal systems: drop on demand where ink droplets for printing are generated as and when required; and continuous ink jet printing in which droplets are continuously produced and only selected ones are directed towards the substrate, the others being recirculated to an ink supply.

Continuous ink jet printers supply pressurized ink to a print head drop generator where a continuous stream of ink emanating from a nozzle is broken up into individual regular drops by, for example, an oscillating piezoelectric element. The drops are directed past a charge electrode where they are selectively and separately given a predetermined charge before passing through a transverse electric field provided across a pair of deflection plates. Each charged drop is deflected by the field by an amount that is dependent on its charge magnitude before impinging on the substrate whereas the uncharged drops proceed without deflection and are collected at a gutter from where they are recirculated to the ink supply for reuse. The charged drops bypass the gutter and hit the substrate at a position determined by the charge on the drop and the position of the substrate relative to the print head. Typically the substrate is moved relative to the print head in one direction and the drops are deflected in a direction generally perpendicular thereto, although the deflection plates may be oriented at an inclination to the perpendicular to compensate for the speed of the substrate (the movement of the substrate relative to the print head between drops arriving means that a line of drops would otherwise not quite extend perpendicularly to the direction of movement of the substrate).

In continuous ink jet printing a character is printed from a matrix including a regular array of potential drop positions. Each matrix comprises a plurality of columns (strokes), each being defined by a line including a plurality of potential drop positions (e.g., seven) determined by the charge applied to the drops. Thus each usable drop is charged according to its intended position in the stroke. If a particular drop is not to be used then the drop is not charged and it is captured at the gutter for recirculation. This cycle repeats for all strokes in a matrix and then starts again for the next character matrix.

Ink is delivered under pressure to the print head by an ink supply system that is generally housed within a compartment of a cabinet that includes a separate compartment for control circuitry and a user interface panel. The system includes a main pump that draws the ink from a reservoir or tank and delivers it under pressure to the print head. As ink is consumed the reservoir is refilled as necessary from a replaceable ink cartridge that is releasably connected to the reservoir by a supply conduit. The ink is fed from the reservoir via a flexible delivery conduit to the print head. The unused ink drops captured by the gutter are recirculated to the reservoir via a return conduit by a pump or venturi. The flow of ink in each of the conduits is generally controlled by solenoid valves and/or other like components.

Filtration of the ink is provided to capture or limit the amount of particulate in the ink that is delivered to the print head for printing. More specifically, a filter module provides a filter medium in the ink flow path from an ink source to the print head. Filters used in these printing systems have a known effective life span, so the replacement of the filters is performed at timed service intervals. The replacement of the filters can be time consuming, which means the continuous ink jet printer is not operating, which is not desirable for production line printing and marking. Moreover, when a filter module is replaced it often contains an amount of ink such that it is regarded as HAZMAT waste and special precautions must be taken to dispose of the filter module.

BRIEF SUMMARY

The present disclosure provides a filter module with self-sealing valve assemblies, that is configured to leave a minimal amount of printing fluid in the module after use.

In one aspect, a filter module for a continuous inkjet printer includes a filter housing, a filter medium fixed within the housing, and an inlet portal through which ink flows into the housing under pressure. A first self-sealing valve assembly is disposed within the inlet portal. Ink flows out of the housing under pressure through an outlet portal. A second self-sealing valve assembly is disposed within the outlet portal. The first and second valve assemblies open when mechanically connected to an ink flow path from an ink tank to a print head, and the first and second valve assemblies seal closed when mechanically disconnected from the ink flow path.

In another aspect, a continuous inkjet printer includes an ink tank for holding ink, a print head in fluid communication with the ink tank and the print head having an ink nozzle for ejecting ink droplets onto a substrate to print an image, an ink flow path providing fluid communication from the ink tank to the print head, and a pump disposed in the ink flow path and in fluid communication with the ink tank and print head for delivering ink from the ink tank to the print head under pressure. A filter module is disposed in the ink flow path between the pump and the print head.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

BRIEF DESCRIPTION OF DRAWINGS

The invention is explained in the following description in view of the drawings that show.

DETAILED DESCRIPTION OF INVENTION

The inventors have recognized that during servicing a continuous inkjet printer, filter modules that are to be replaced often contain a sufficient volume of ink such that the component is regarded as HAZMAT, thereby requiring certain precautions in terms of disposing of the filter module. Filter modules sometimes have a tendency to leak when being replaced thereby fouling the work area and parts of the printer. In addition, the removal of filter modules is oftentimes a relatively complicated task that can be time consuming and messy. Accordingly, the inventors have developed a "self-sealing" filter module that minimizes or eliminates ink leakage upon removal from a continuous inkjet ink flow path. To that end, the filter is adapted to maximize the emptying of ink from the filter module when pressure in ink lines and the filter module is removed. Accordingly, the filter module in accordance with embodiments of the invention is provided that empties ink from the filter module so there is less than a certain amount (e.g., 30 mL) that avoids the necessity of HAZMAT precautions for disposal.

Figure 1:
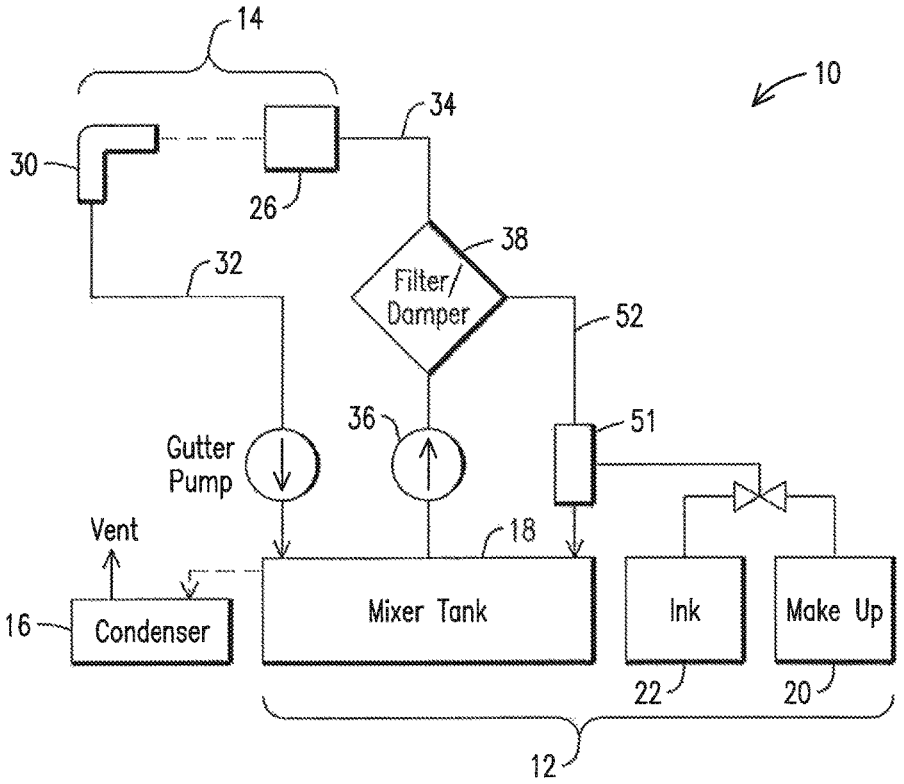
FIG. 1 is a schematic illustration of ink flow circuit for a continuous inkjet printer.

Now in reference to FIG. 1, an ink flow circuit for a continuous ink jet printer 10 is illustrated. The printer 10 includes a fluid system 12, a print head 14, and a condenser 16. The fluid system 12 includes an ink or mixer tank 18 for holding ink, a makeup tank 20 for holding solvent and an ink source 22. The ink source 22 and makeup tank 20 provide fluids to mixer tank 18. Solvent is added to the ink or mixer tank 18 during operation of the printer to replace solvent loss due to evaporation and to properly control the ink viscosity. Inks for continuous ink jet printers are typically complex mixtures of many substances, with a large proportion of volatile organic solvents. Typical organic solvents include methyl ethyl ketone (MEK), acetone, and ethanol. The print head 14 includes a nozzle 26 in fluid communication with the ink tank 18 for ejecting ink droplets and a gutter 30 for receiving, through an ink-receiving inlet thereof, ink droplets which are not used for printing. A gutter flow path 32 starts at the ink-receiving inlet or orifice of the gutter 30 and provides fluid communication to the ink tank, for ink and air that has entered the gutter 30 through the ink-receiving inlet. A return line (not shown) may be placed in fluid communication with the gutter 30 for conveying air from the condenser 16 to the gutter 30 and to enter the gutter flow path 32, which returns ink to the mixer tank 18.

Figure 2:
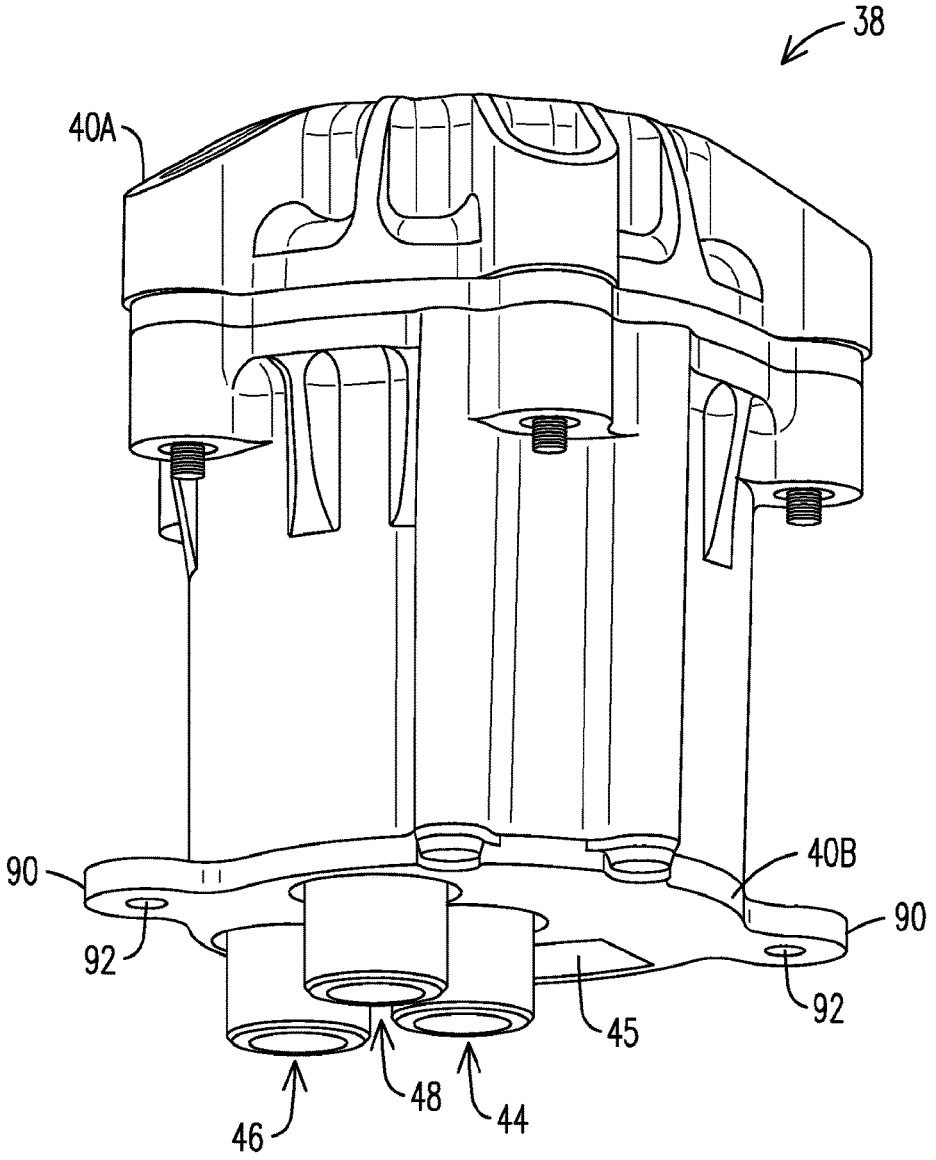
FIG. 2 is a bottom perspective view of a filter module in accordance with embodiments of the invention.

Ink is supplied to the print module or print head 14 via an ink flow path 34. A pump 36 is provided in the ink flow path 34 to deliver ink to the print head 14 under pressure for printing. In addition, a filter module 38 is provided in the ink flow path 34 between the pump 36 and the print head 14 to filter particulates from the ink before it reaches the print head 14. The filter module 38 is shown in more detail in FIGS. 2 and 3, and includes a housing 40 with a top 40A and bottom 40B. A filter medium 42 is mounted within the housing 40 to filter ink supplied to the module 38 under pressure. The filter may be a 5μ polypropylene filter capable of filtering ink supplied to the module at a pressure of about 2.5 barr to about 3.5 barr.

The module 38 includes an inlet port 44 and outlet port 46, on the bottom 40B of the module 38, and through which ink enters and exits the module 38. A second outlet port 48 may also be provided for returning ink in the module 38 to the mixer tank 18 via a return line 52. In order to maintain pressure in the module 38 at a desired level or within a desired range, some ink in the module 38 is periodically vented through the second outlet port 48 by operation of venturi pump 51 and returned to the mixer tank 18, while ink continues to flow to the print head 14. In addition, or alternatively, the second outlet port 48 and/or additional ports may be incorporated in the module 38 to circulate pigmented ink to through the module (and not necessarily through the filter medium 42) so that pigment of the ink does not collect or settle in the ink tank 18.

The module may be provided with an electronic data storage device such as a memory chip 45 with surface-mounted electrical contacts for connection to corresponding contacts provided on the printer. The memory chip 45 may be any suitable electronic storage device, may be supported on any suitable substrate and may be connected to suitable electrical contacts (or contact) in any convenient manner, providing those contacts are accessible for connection to the printer when the filter module 38 is inserted in the printer. The memory chip 45 includes at least Read Only Memory (ROM). The data on the memory chip can be any suitable data and would typically include such information as filter module serial number, production date, model number, expiration date, and the like. The memory chip may include security data so that only suitable or recognized filter modules can be used with the printer. Other data on the memory chip 45 could include fluid type (such as solvent, ink type, or dye-based or pigmented ink), service life, and the like. The memory chip may also include a writable data portion. The printer may write to the memory chip to indicate that the filter module has reached the end of its service life, so that the filter module can no longer be used in the printer or any other printer.

Self-sealing valve assemblies 54, 56 are mounted within the inlet port 44 and outlet port 46, respectively. A similar valve assembly may also be mounted in the second outlet port 48. Since the valve assemblies 54, 56 are identical in structure and function, the below description of valve assembly 54 applies to the valve assemblies 54, 56 of both outlet ports 46, 48. These self-sealing valve assemblies 54, 56 allow for the mechanical connection of the module 38 to the ink flow path, and when disconnecting the module 38 from the ink flow path, minimize or eliminate ink leakage.

Figure 4:
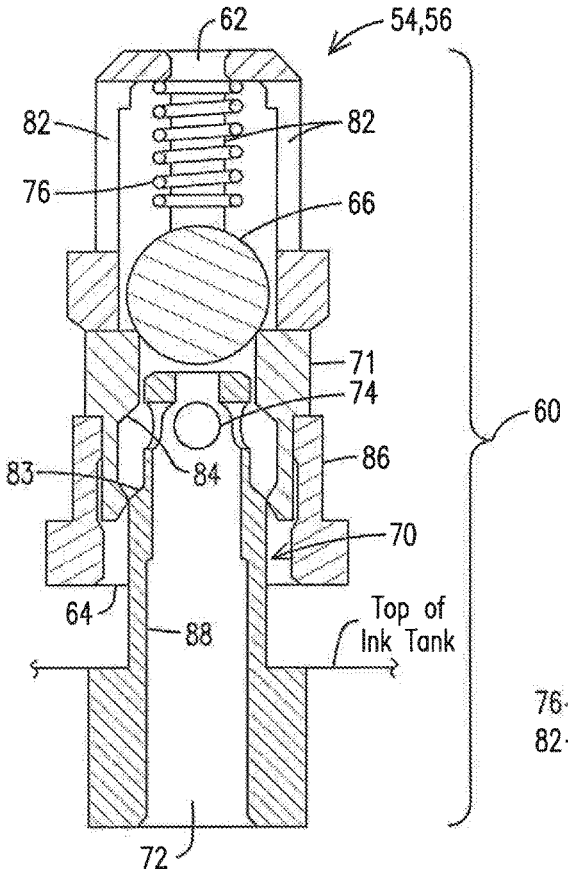
FIG. 4 is a sectional view of a self-sealing valve assembly in accordance with embodiments of the invention.
Figure 5:
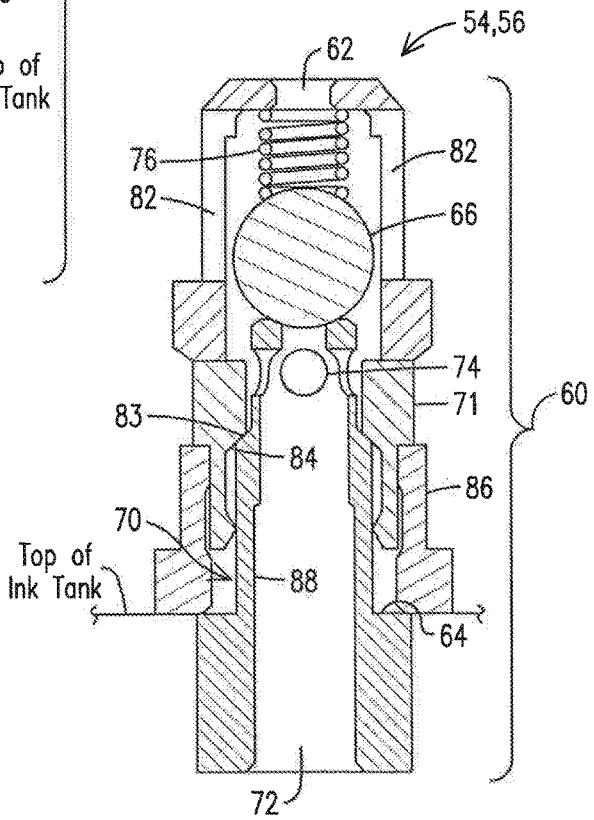
FIG. 5 is a sectional view of the self-sealing valve of FIG. 4 actuated to an open position.

With respect to FIGS. 4 and 5, the valve assembly 54 is illustrated in more detail and includes a valve housing 60 having a top end 62 and first opening 64 at the bottom of the assembly 54 distal to the top end 62. In particular, the valve assembly is depicted engaging an ink flow pin 70 that is mounted to a top of an ink tank. The ink tank may include at least two of the ink flow pins 70 to engage or open valve assemblies 54, 56. As shown in FIG. 4, a biasing mechanism 76, such as a spring, biases a ball 66 toward the second opening 64 and against a seal 71, when in a closed position. When the filter module 38 is fixed to an ink tank, the ink flow pin 70 extends through the first opening 64 and the seal 71 to move the ball 66 toward the top end 62 of the valve housing 60. More specifically, and as shown in FIG. 5, when the valve assemblies 54, 56, or filter module 38, is mechanically connected to the ink flow path and ink container, the pin(s) 70 force the ball 66 toward the top end 62 to open the valve assemblies 54, 56. The ink flow pin 70 includes a conduit 72 and apertures 74 through which ink flows into the module 38 through side openings 82 in the valve assembly 54. When the module 38 is connected to ink flow path 33 the valve assemblies 54, 56 automatically open for ink flow through the module 38, filter medium 42 and to the print head 14. The terms "mechanically connected" and "mechanically disconnected" refer to the mechanical interaction between the components of the filter module 38 and parts and/or components connected to the ink path or ink tank of the printer, where the mechanical interaction serves to open and close valves to control ink flow through the filter module.

As further shown in FIGS. 4 and 5, in an embodiment of the invention, the ink flow pin 70 comprises a contoured outer surface including an upper shoulder 84 that tapers inward relative to a shaft 88 of the pin 70. In addition, an internal surface 84 of the seal 71 is contoured as well generally corresponding to the shape of the pin 70 at the shoulder 84. Accordingly, when the valve assembly 54 and filter module 38 are fixed on the ink tank an inclined surface 84 of the seal 71 abuts the shoulder 81 of the pin 70. This sealed interface between the pin 70 and seal 71 prevents any back flow of ink leaking out of the valve assembly 54 during operation of the print system 10. To that end, given that valve assembly 56 is configured identical to valve assembly 54, the similar sealed interface at valve assembly 56 prevents ink that is flowing out of the filter module 38 from leaking out of the filter module 38 and valve assembly 56. The seal 71 is further configured and dimensioned at the first opening 64 and within a base 86 of housing 60 to provide a seal against the shaft 88 to further prevent ink from leaking from the valve assembly 54 and also support the filter module 38 on the ink tank. Again in reference to FIG. 2, flanges 90 with bolt holes 92 may be provided at toward the bottom of the housing 60 to affix the module 38 to an ink tank with bolts or other fasteners.

When servicing the printer 10, the ink pump 36 is deactivated removing pressure from within the internal volume of the module 38, and the ink vents through the second outlet port 48 via the return line 52 and venturi pump 51, and is returned to the ink tank 22. However, as the valve assemblies 54, 56, and the similar valve assembly of the second outlet port 48, remain open, the ink flow pin 70 abuts the seal 71, as described above, preventing or minimizing ink leakage. When the module 38 is disconnected from the ink flow path 33, the biasing mechanism 76 forces the ball 66 against seal 71, automatically closing the valve assemblies 54, 56 so that any remaining ink in the module 38 does not escape.

While embodiments of the invention described herein show the valve assemblies 54, 56 depending from a bottom 40B of the housing 40, the invention is not so limited to such a configuration. For example, the valve assemblies 54, 56 could be could be disposed entirely within the housing 40 such that second opening 64 is generally flush with a bottom of housing 40 or is disposed entirely within the housing 40.

Figure 3:
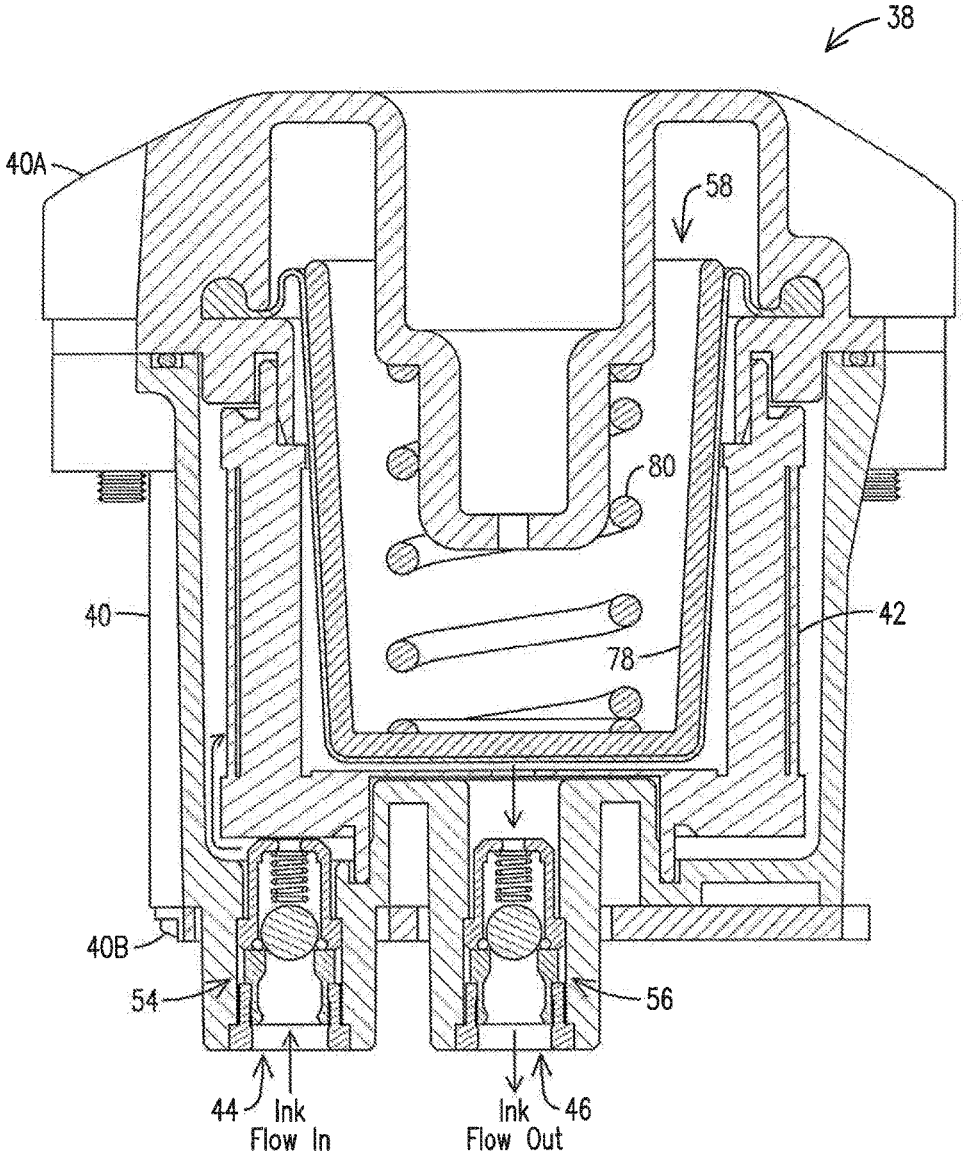
FIG. 3 is a sectional view of the filter module of FIG. 2.

In the embodiment illustrated in FIG. 3, the module 38 may also comprise an ink flow pressure damper 58 that is used to control or minimize pressure fluctuations in the ink flow path 33. As will be described in more detail below, the damper 58 may also assist in evacuation of ink from the module 38. The damper comprises a diaphragm 78 operatively connected to the top 40A of the housing 40 and that is suspended within the module 38 and an inner circumference of the filter medium 42. A biasing mechanism 80, such as a helical coil spring, is also operatively connected to the top 40A of the housing 40 and is positioned within the diaphragm 78 to bias the diaphragm 78 toward the bottom 40B of the housing 40 and valve assemblies 54, 56.

When ink is supplied to the module 38 under pressure, the ink flow forces the biasing mechanism 80 and diaphragm 78 toward the top 40A of the housing 40. The biasing member 80 and diaphragm 78 apply a counter force against the pressurized ink flow to thereby absorb pressure fluctuations in the ink flow. When pressure is removed from the module 38 by deactivating the pump 36, the biasing mechanism 80 forces the diaphragm toward the valve assemblies 54, 56 and the valve assembly of the second outlet portal 48 thereby forcing ink to evacuate from the chamber of the module 38. In this manner, when the module 38 is disconnected from ink flow path 33 only a nominal amount of ink remains and the module 38 can be discarded in the normal waste stream without the need to take precautions for disposing of a toxic waste. Preferably, after being used and then removed from the printer, the spent module includes less than 30 mL, less than 20 mL, or less than 10 mL of printing liquid.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

What is claimed is:

1. A filter module for a continuous inkjet printer, comprising:

a filter housing having a top end and a bottom end;

a filter medium fixed within the housing, wherein the filter medium has a wall defining an internal open volume of the filter medium, and an end of the filter medium facing the bottom end of the filter housing;

an inlet portal at the bottom end of the filter housing and through which ink flows into the filter housing under pressure and through the wall of the filter medium into the internal volume of the filter medium and the end of the filter medium;

a first self-sealing valve assembly disposed within the inlet portal;

an outlet portal at the bottom end of the filter housing and through which ink flows out of the housing under pressure from the end of the filter medium;

a second self-sealing valve assembly disposed within the outlet portal;

wherein the first and second valve assemblies open when mechanically connected to an ink flow path from an ink tank to a print head, and the first and second valve assemblies seal closed when mechanically disconnected from the ink flow path; and, an ink flow pressure damper disposed within the filter housing to control pressure fluctuations of ink in the ink flow path, the ink flow pressure damper, comprising:

a diaphragm at least a portion of which is disposed within the open internal volume of the filter medium and having an end facing the bottom end of the housing and the outlet portlet; and, a biasing mechanism operatively connected to the filter housing and the second end of the diaphragm to bias the diaphragm toward the outlet portal.

2. The filter module of claim 1, wherein each of the first and second self-sealing valve assemblies includes a spring actuated ball valve comprising:

a valve housing with a first opening at a bottom of the valve housing and through which ink may flow and a top end with one or more second openings through which ink may flow;

a ball within the valve housing;

a biasing mechanism that biases the ball toward the first opening and against a seal of the housing; and, wherein when the filter is connected to the ink flow path from an ink tank, the ball is forced against biasing mechanism and from contact with the seal to open the valve, and when the filter is disconnected from the ink flow path the biasing mechanism forces the ball toward the opening and against the seal to close the valve.

3. The filter module of claim 1, wherein the outlet portal is a first outlet portal and the filter module further comprising:

a second outlet portal; and, a third self-sealing valve assembly disposed within the second outlet portal;

wherein the third valve opens when mechanically connected to an ink flow path from the filter to the ink tank, and the third valve seals closed when mechanically disconnected from this ink flow path.

4. The filter module of claim 1 further comprising an electronic storage device for storing data relating to the filter module.

5. A continuous inkjet printer comprising:

an ink tank for holding ink;

a print head in fluid communication with the ink tank and the print head, comprising:

an ink nozzle and droplet generator configured to generate ink droplets that are ejected onto a substrate to print an image;

a charging electrode downstream of the droplet generator to selectively apply a charge to ink droplets;

a deflection electrode for deflection charged ink droplets; and, a gutter comprising a gutter entrance through which uncharged droplets enter for recirculation; and, an ink flow path providing fluid communication from the ink tank to the print head;

a pump disposed in the ink flow path and in fluid communication with the ink tank and print head for delivering ink from the ink tank to the print head under pressure; and, a filter module disposed in the ink flow path between the pump and the print head, wherein the filter module, comprises:

a housing;

a filter medium fixed in the housing;

an inlet portal in the housing through which ink flows into the housing;

a first self-sealing valve disposed within the inlet portal that opens when the filter module is mechanically connected to the ink flow path and seals closed when mechanically disconnected from the ink flow path;

an outlet portal in the housing through which ink flows out of the housing;

a second self-sealing valve assembly disposed within the outlet portal that opens when the filter module is mechanically connected to the ink flow path and is sealed closed when mechanically disconnected from the ink flow path; and, wherein the ink tank defines a generally enclosed internal volume holding the ink, and the filter medium is within the filter housing and disposed externally relative to the internal volume of the ink tank.

6. The continuous inkjet printer of claim 5, wherein the outlet portal is a first outlet portal and the housing includes a second outlet portal and the printer further comprising:

a third self-sealing valve assembly disposed within the second outlet portal;

wherein the third valve opens when mechanically connected to an ink flow path from the filter to the ink tank, and the third valve seals closed when mechanically disconnected from this ink flow path.

7. The continuous inkjet printer of claim 6, further comprising a venturi pump in the ink flow path from the filter module to the ink tank.

8. The continuous inkjet printer of claim 5, further comprising an ink flow pressure damper disposed within the module housing to control pressure fluctuations of ink in the ink flow path, and the ink flow pressure damper, comprising:

a diaphragm having an opening in a first end thereof facing a top end of the filter housing, and at least a portion of the diaphragm is disposed through the opening of the filter housing and within the filter housing, and the diaphragm having a second end facing the outlet portal at the bottom end of the filter housing; and, a biasing mechanism operatively connected to the filter housing and the second end of the diaphragm to bias the diaphragm toward the outlet portal.

9. The continuous inkjet printer of claim 8, wherein the filter medium has a generally cylindrical configuration and at least a portion of the diaphragm is disposed within a circumference of the filter medium.

10. The continuous inkjet printer of claim 5, wherein the ink tank comprises a first ink flow pin to engage and actuate the first self-sealing valve assembly and a second ink flow pin to engage and actuate the second self-sealing valve assembly.

11. The continuous inkjet printer of claim 5 wherein the filter module comprises an electronic data storage device for storing data relating to the filter module and the inkjet printer is configured to read the data from the electronic data storage device.

12. The continuous inkjet printer of claim 5 wherein the filter module is configured such that after the filter module has been used in the printer and then removed from the printer, the filter module includes less than 30 mL of liquid.

13. A filter module of claim 1, wherein the filter medium has a first end with an opening facing the top end of the filter housing and the end of the filter medium facing the bottom end of the filter housing is a second end, and the diaphragm has an opening in a first end thereof facing the top end of the filter housing, and the end of the diaphragm facing the bottom end of the filter housing and the outlet portal is a second end, and wherein at least a portion of the diaphragm extends through the opening of the filter medium and in the open internal volume of the filter medium.

* * * * *